United States Patent [19]

Ross

[11] Patent Number: 4,765,627

[45] Date of Patent: Aug. 23, 1988

[54] NUCLEAR WAR GAME

[76] Inventor: Sherman E. Ross, 2280 Locust St., Denver, Colo. 80207

[21] Appl. No.: 9,505

[22] Filed: Feb. 2, 1987

[51] Int. Cl.[4] ..... A63F 3/00

[52] U.S. Cl. ..... 273/255

[58] Field of Search ..... 273/254, 255, 262, 265

[56] References Cited

U.S. PATENT DOCUMENTS

| | | | |
|---|---|---|---|
| 3,638,946 | 2/1972 | Bain | 273/254 |
| 3,811,679 | 5/1974 | Benge | 273/262 |
| 3,831,944 | 2/1974 | Upton | 273/262 |
| 3,998,463 | 12/1976 | Iumchak | 273/262 |
| 4,055,346 | 10/1977 | Garcia-Kuenzli | 273/262 |
| 4,221,389 | 9/1980 | Read | 273/262 |
| 4,687,206 | 8/1987 | Cordry et al. | 273/262 |

FOREIGN PATENT DOCUMENTS

| | | | |
|---|---|---|---|
| 1352237 | 7/1964 | France | 273/255 |

*Primary Examiner*—Richard C. Pinkham

*Assistant Examiner*—Benjamin Layno

[57] ABSTRACT

An amusement device, specifically a board game simulating nuclear conflict between two players representing the United States and Soviet Union in which the participants assume alternate roles of attacker and defender. The game's object is for a player to destroy 21 of his opponent's 36 targets (designated as "COUNTERFORCE" and "COUNTERVALUE" targets). The game consists of a playing surface featuring outlines of the two countries (ref num 1,3) with the various targets on an alphanumeric grid pattern, playing pieces representing "missiles" used by both players in attack and defense (ref num 12,13), "Launch Coordinate" and "Target Coordinate" cards (ref num 9–10) which provide a random means for determination of both origin and destination of attacking missiles, "Megadeath" markers (ref num 14) which signify that a target has been destroyed, lists of targets, and dice which govern movement of attacker and defender missiles.

1 Claim, 5 Drawing Sheets

10

14

11

12

13

NUCLEAR WAR GAME

This invention, "FIRST-STRIKE: The Nuclear War Game" relates to the field of games and amusement, specifically to board games in which the players assume alternate roles of attacker and defender.

Heretofore, numerous board games dealing with the subject of war have been developed in which the players alternate between attack and defense. In these games the "conflict" that is waged in "conventional" (i.e., non-nuclear) in nature, with victory being attained either by the movement of armies, navies, et cetera (usually represented by playing pieces or coasters) to outmaneuver, destroy or otherwise defeat those of an opponent, or by conquest of an opponent's country/territory. The subject of nuclear war has not been addressed in these types of games, probably because of one, the difficulty involved in development of a game in which a "controlled" nuclear war can be waged and two, the perception (probably quite correct in an actual situation) that a nuclear war is a conflict where victory by either side cannot be attained.

An objective of this invention is to provide a board game in which the two players engage in warfare by "nuclear", rather than "conventional", means. The two players, representing the United States and Soviet Union accomplish this by utilization of "missiles" (represented by playing pieces) in both attach and defense. Victory is achieved by movement of these missiles and destruction of targets within an opponent's country rather than movement of armies or conquest of territory.

While this invention does not solve any real problems, address any tangible need, or improve the "prior art" I believe it is a very novel idea which provides a new form of amusement and may be of recreational interest to a large segment of the population.

DRAWING REFERENCE NUMERALS

FIG. 1

1 game board with alphanumeric grid pattern

2 Outline of Soviet Union

3 Outline of United States

4 Indicia denoting "COUNTERVALUE" target site

5 Indicia denoting "ABM COUNTERFORCE" launch/target site

6 Indicia denoting "ICBM COUNTERFORCE" launch/target site

7 Indicia denoting "FAIL-SAFE"

8 Indicia denoting antiparallel demarcation

Figure 5:
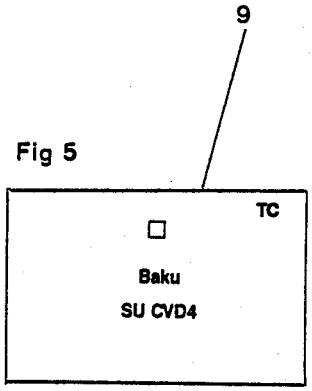
FIG. 5 is an example of a Target Coordinate Card.

9 FIG. 5 Target Coordinate Card with indicia denoting target type (□), target name (Baku), and target grid coordinates (SU CVD4)

Figure 6:
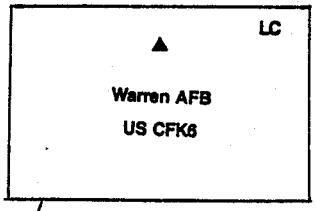
FIG. 6 is an example of a Launch Coordinate Card.

10 FIG. 6 Launch Coordinate Card with indicia denoting ICBM COUNTERFORCE symbol ( ), name of launch site (Warren AFB), and launch site grid coordinates (US CFK6)

Figure 7:
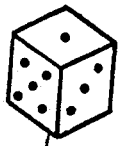
FIG. 7 shows a die used in the game.

11 FIG. 7 Die used in game

Figure 8:
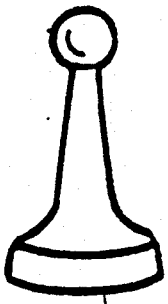
FIG. 8 shows an ICBM playing piece.

12 FIG. 8 ICBM playing piece

Figure 9:
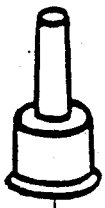
FIG. 9 shows an ABM playing piece.

13 FIG. 9 ABM playing piece

Figure 10:
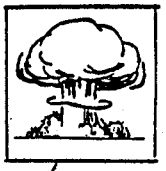
FIG. 10 shows a Megadeath marker.

14 FIG. 10 Megadeath marker symbol

Figure 1:
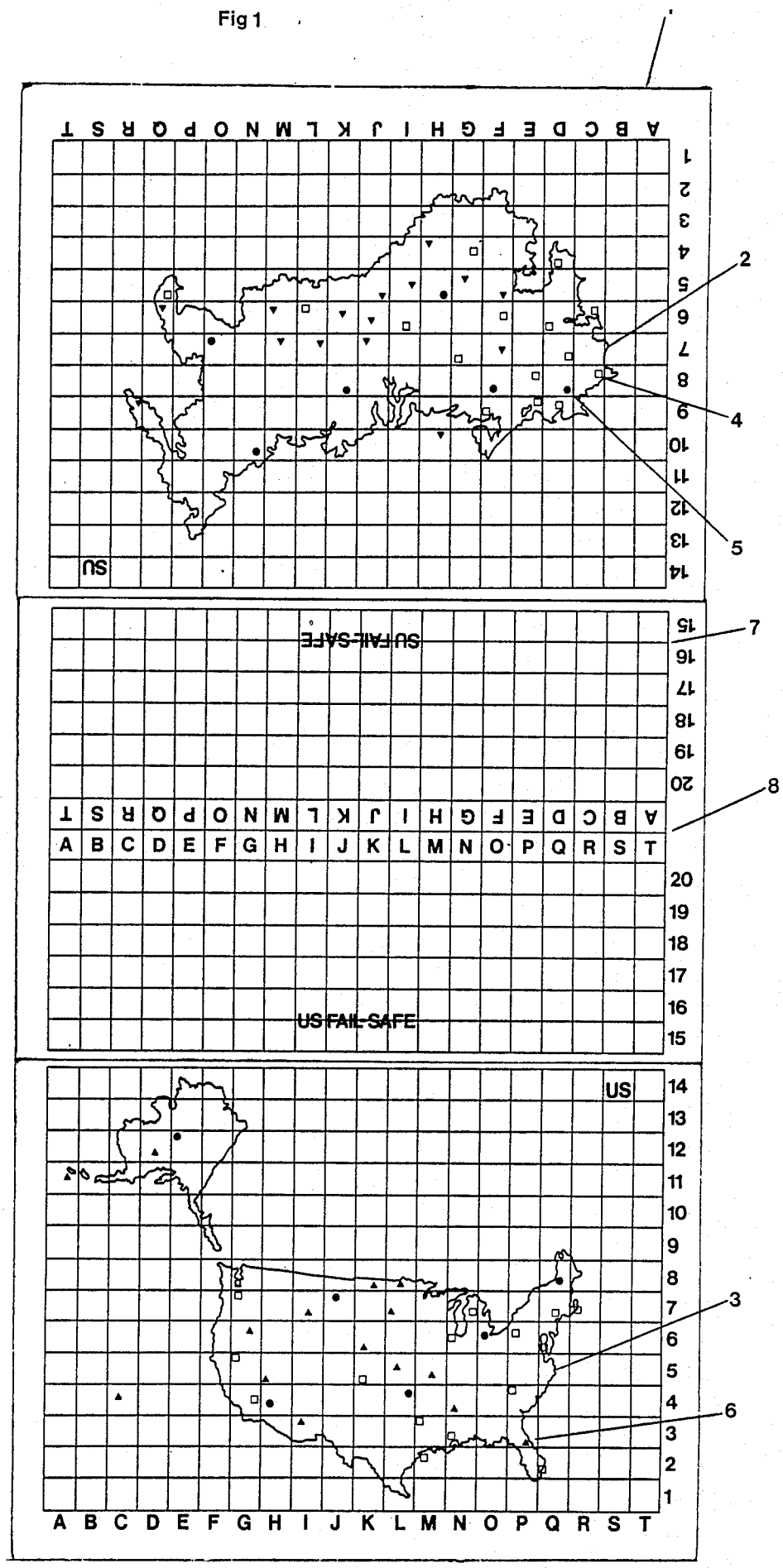
FIG. 1 shows view of the gameboard apparatus.

Description of Invention FIG. 1

The following provides a detailed physical description of the invention, FIRST-STRIKE: The Nuclear War Game. In reference to FIG. 1 a view of game board 1 with alphanumeric grid pattern is presented. The playing surface of the board is subdivided into squares of 0.75 inch×0.75 inch. In addition to the alphanumeric grid salient features of the game board include outlines of Soviet Union 2 and United States 3 with indicia denoting the seventy-two various launch and target sites (4,5,6) at opposing ends.

Figure 2:
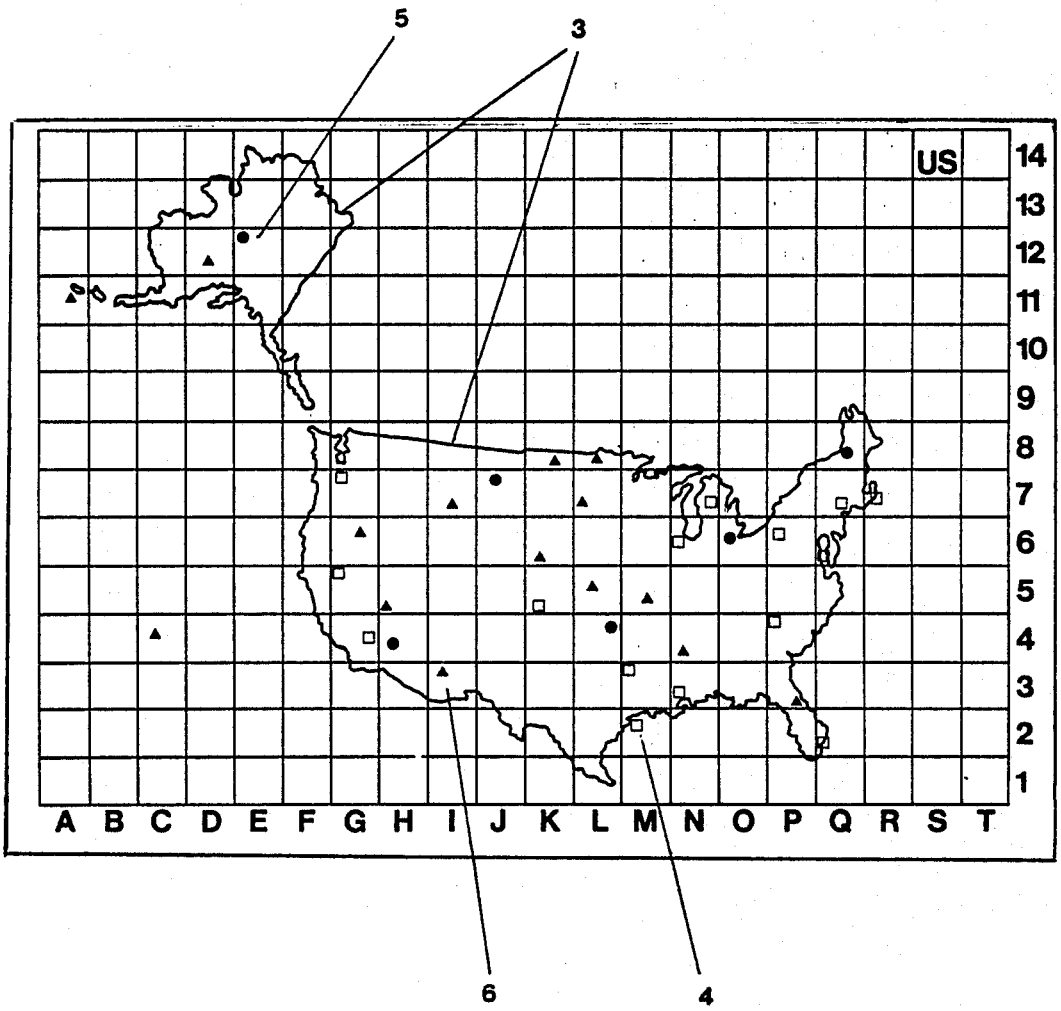
FIG. 2 shows detail of a portion of the game board shown in FIG. 1.
Figure 3:
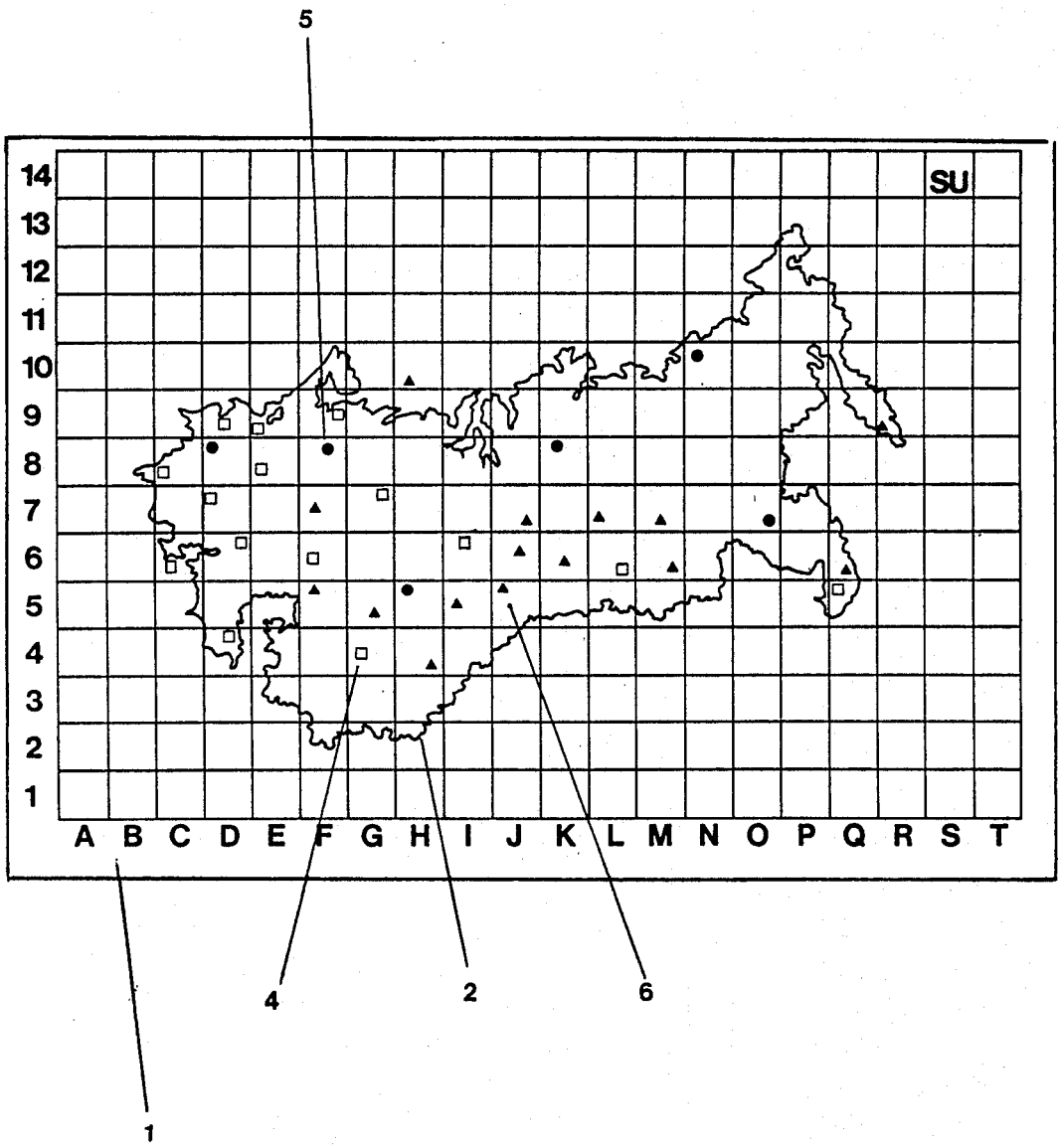
FIG. 3 shows detail of a portion of the game board shown in FIG. 1.
Figure 4:
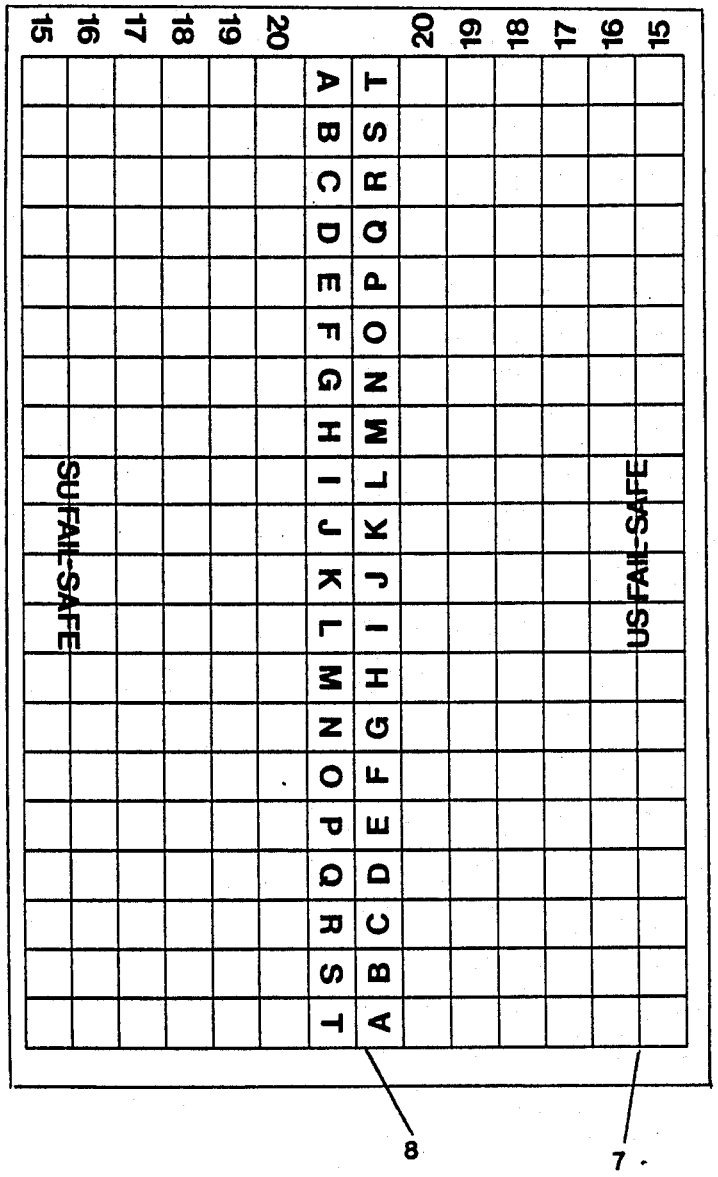
FIG. 4 shows detail of the center portion of the game board shown in FIG. 1.

The alphanumeric grid pattern is arranged with numbers on the longitudinal axis and letters on the laterial axis of the game board. FAIL-SAFE lines 7 and an antiparallel demarcation 8 serve as boundaries between the two countries. The game board itself has total dimensions of 33¼ inch×17 inch and is die-cut into three panels. FIGS. 2–4 show a more detailed view of the game board panels in FIG. 1 with indicia denoting country (2,3), launch/target site locations (4,5,6), FAIL-SAFE lines (7) and the antiparallel demarcation (8). The two outer panels have dimensions of 11θ inch×17 inch; the inner panel is 10¾ inch×17 inch.

FIG. 5 provides an example of one of the seventy-two Target Coordinate Cards 9 used in the game. In the upper right hand corner is the designation TC, indicaing "Target Coordinate". The upper central portion of the card has indicia denoting whether the target site is ICBM COUNTERFORCE (▲), ABM COUNTERFORCE (●), or COUNTERVALUE (□) target type. The center of the card has indicia denoting target site name, country where target site is located (US or SU), type of target site (CF or CV) and target site location.

FIG. 6 is an example of one of the thirty Launch Coordinate Cards 10 used in the game. In the upper right hand corner is the designation LC, denoting "Launch Coordinate". The upper central portion of the card has indicia denoting ICBM COUNTERFORCE (▲). The center of the card has indicia denoting launch site name, country where launch site is located (US or SU), CF designation, and launch site locaion. The Launch Coordinate 9 and Target Coordinate 10 Cards are either red or white (see Page 15) and have dimensions of 2½ inch×1½ inch.

FIG. 7 shows a die used in the game. The die is ⅝ inch square and is white with black spots or red with white spots. FIG. 8 is the ICBM playing piece 12 used in the game. The ICBM piece 12 is either red or white polysyrene plastic with dimensions 1 inch (height)×⅝ inch (base). FIG. 9 shows the ABM playing piece 13. The ABM piece 13 is red or white polystyrene plastic with dimensions 11/16 inch (height)×7/16 inch (base). FIG. 10 shows the Megadeath marker 14 having indicia representing a mushroom cloud symbol on card stock with dimensions of ¾ inch×¾ inch.

OPERATION OF INVENTION

The following section is a detailed description of the invention's operation, i.e., how the game is played. This portion shall be broken down into the following categories: the object of the game, a restatement of the game's components (with emphasis placed on their role in the game), and instruction on how the game is played.

OBJECT OF GAME

In war, victory is usually attained by the side that inflicts greater material damage on an opponent than it receives. In "FIRST-STRIKE" such is accomplished by the utilization of intercontinental ballistic missile playing pieces ("ICBM", 12) and anti-ballistic missile playing pieces ("ABM", 13) in both attack and defense, respectively. A "turn" is defined as the expenditure of up to three ICBM by each player; five turns constitutes a nuclear "salvo". In this game, the first player to destroy 21 of an opponent's targets (▲●□, in any combination) is the winner.

MATERIAL

1 "Nuclear Battlefield" playing surface (33¼ inch×17 inch) utilizing an alphanumeric grid system (henceforward referred to as "the grid") which facilitates both movement and targeting of missiles during the game. "FAIL-SAFE" lines (ref num 3) and an antiparallel demarcation line 8 serve as imaginary boundaries between the United States 3 and Soviet Union 2. FOr each country the targets consist of 21 *military* (designated "COUNTERFORCE" and denoted by the symbols ▲●, corresponding to ICBM and ABM launching sites, respectively) and 15 *civilian* (designated "COUNTERVALUE" and denoted by the symbol□).

72 Target Coordinate Cards:

36 red cards that give target name, type and grid coordinates 9 of US targets (these cards are used by SU player during the game); 36 white cards that give target name, type and grid coordinates 9 of SU targets (these cards are used by the US player during the game). These cards are randomly drawn for target selection when player is on OFFENSE.

30 Launch Coordinate Cards: 15 red cards that give launching site name and grid coordinates (10) of SU ICBM COUNTERFORCE (these cards are used by SU player during the game); 15 white cards that give launching site name and grid coordinates (10) of US ICBM COUNTERFORCE (these cards are used by US player during the game. These cards are randomly drawn for launch site selection when player is on OFFENSE.

30 ICBM (12) Used when player is on OFFENSE.

30 ABM (13) Used when player is on DEFENSE.

41 Megadeath markers:

(14) placed on targets that are destroyed during the game.

4 dice: 2 white (US player uses), 2 red (SU player uses) are used by both players to determine movement of ICBM and ABM; die is also used to determine launch site of DEFENSE ABM.

INSTRUCTIONS FOR PLAY

Attack (▲)

To begin, players choose either the US or SU; each player receives 15 ICBM playing pieces, 15 ABM playing tiles (missiles are sequestered off of the grid until use), and the respective Launch and Target Coordinate Cards. Both players roll one die to determine who attacks first (highest roll attacks first). When on OFFENSE a player may launch up to three ICBM per turn at targets in his opponent's country, but only one at a time and only one ICBM may be launched from a particular ▲ site during that turn. Once an ICBM has been launched no others may be fired until (1) it destroys its target, (2) it "misses" its target, or (3) it is destroyed by DEFENSE action. A player's turn is defined as the launching of ICBM (up to three) at his opponent's country; after the last missile has destroyed its target or has been destroyed roles are reversed.

To attack, player on OFFENSE draws one Launch Coordinate Card and one Target Coordinate Card (cards should be kept face down in separate stacks; the random draw provides variability in selection of both the origin and destination of ICBM). To read launch and target coordinates player uses the alphanumeric grid of the gameboard. For example, SU player wishes to launch a missile at Denver (#USCVK5) from the ICBM site at Petropavlovsk (#SUCFR9). Using the longitudinal axes of the board he "launches" the ICBM tile from where *column* R intersects *row* 9 ( ▲ symbol). The target (Denver) is located where the US coordinates *column* K intersects *row* 5. Random launch site and target selection is made for each ICBM fired. If a player on OFFENSE draws a Launch Coordinate Card of a site that has been previously destroyed he must discard one ICBM from his arsenal (the card is removed from the stack). For this turn he can launch no more than 2 ICBM, since three were available for launch but one was "destroyed".

OFFENSE player places ICBM pieces on grid at site indicated on the Launch Coordinate Card (ICBM can only be launched from a ▲ site), rolls two dice and moves ICBM indicated number of spaces in a longitudinal (lengthwise) manner down grid. For example, an ICBM (12) launched from an ICBM site in *column* F must travel down that column until it reaches the *row* occupied by its target; at this point the missile may be moved laterally toward target. OFFENSE player continues to roll dice and move ICBM until the missile crosses the OFFENSE player's FAIL-SAFE, at which time DEFENSE player must take countermeasure (see DEFENSE section). ICBM cannot take "evasive" action to avoid interception by DEFENSE ABM; Offense player must move ICBM in response to dice roll even if such movement would place ICBM in direct proximity (i.e., adjacent) to ABM. For example, if ABM is 5 spaces from ICBM and OFFENSE player rolls a "4", OFFENSE player move missile even though such movement would place the ICBM in a space adjacent to ABM. If ICBM *lands* on space occupied by ABM, the ABM is considered to have "missed" and is removed from the grid.

Once ICBM crosses the DEFENSE player's FAIL-SAFE the OFFENSE player may only roll one die. When the missile reaches the row occupied by the target it may be moved laterally in response to die roll. If ICBM lands on space occupied by target the target is destroyed; missile is removed and replaced by a Megadeath marker (14). If ICBM lands on space adjacent to target, both players roll one die. If OFFENSE roll higher than or equal to DEFENSE roll, the target is destroyed; if DEFENSE roll higher, the ICBM has "missed" and is removed from the grid (note: on FIG. 6 spaces #K5 and #M5 are adjacent to the target). Finally, ICBM cannot "overshoot" target. If OFFENSE player is three spaces from target he can only respond to die rolls of 4 or less. Players "keep score" by the sequestering of Target Coordinate Cards as targets are destroyed.

Defense (●)

As stated above, DEFENSE player can take no action until ICBM crosses OFFENSE player's FAIL-SAFE; at this time the ICBM is "detected" and DEFENSE player must launch ABM. DEFENSE player may launch up to three ABM per turn, but no more than one at any one ICBM. As is the case of OFFENSE, the launching sites of ABM are randomly determined. Table 1 gives the coordinates and names of the US and SU ABM launching sites (see Table 1). To select an ABM launching site DEFENSE player rolls one die; the number rolled is matched to the corresponding number on Table 1. This gives the launching site of the ABM. For example, SU player wants to shoot down an incoming US ICBM. He rolls a "6". From the table, since 6 corresponds to the SU ABM site at Komsomolsk, the ABM launched at that particular ICBM must be fired by Komsomolsk. For each ICBM launched the DEFENSE player must randomly select ABM site involved by using Table 1. In using Table 1, if DEFENSE player selects an ABM site previously destroyed he must discard one ABM from his arsenal; he cannot launch an ABM at the ICBM in question (he must wait until the next ICBM has been launched).

DEFENSE player places ABM tile (13) on ● site selected; on his next roll he rolls one die and moves missle laterally along *row* occupied by ABM site until it arrives at *colunn* occupied by incoming ICBM.

TABLE 1

Launch coordinates of US and SU ABM sites.

| US | | SU | |
|---|---|---|---|
| Site | Co-ordinates | Site | Coordinates |
| 1. Yukon, AL | US CFE12 | 1. Smolensk | SU CFD8 |
| 2. Bakersfield, CA | US CFH4 | 2. Kirov | SU CFF8 |
| 3. Helena, MT | US CFJ7 | 3.Balkhash | SU CFH5 |
| 4. Bartlesville, OK | US CFL4 | 4. Russkaya | SU CFK8 |
| 5. Toledo, OH | US CFO6 | 5. Yakutsk | SU CFN10 |
| 6. Elephant Mount., ME | US CFQ8 | 6. Komsomolsk | SU CFO7 |

At this time the ABM can be moved (in response to die roll) in a longitudinal manner toward ICBM. If ICBM begins lateral movement toward target before intercept ABM can be moved (in response to die roll) laterally or longitudinally (but not diagonally) toward the ICBM. OFFENSE and DEFENSE players take turns rolling dice and moving missiles. For the intercept, ABM must land on space occupied by ICBM or a space adjacent to it. If ABM lands on space occupied by ICBM the ICBM is destroyed by a direct hit; both missiles are removed from the grid. If ABM lands on space adjacent to ICBM both players roll one die. If OFFENSE roll is higher, ABM has "missed" and is removed from the grid; if DEFENSE roll higher than or equal to OFFENSE roll ICBM is "shot down" and both missiles are removed from the grid. The following example illustrates the "interception" of an ICBM by ABM (12,13). The ABM is moved along row 5 to column L, at which time it moves up column L toward the incoming ICBM. Interception cannot take place on space adjacent to target. Finally, DEFENSE does not have to response to die roll if such movement would place ABM further from the ICBM.

Countervalue (□)

In this game the ICBM and ABM installations of both belligerents represent the military element called "COUNTERFORCE" (see Glossary for complete description of terminology). The civilian component comprises the so-called "military-industrial-complex" and is designated the "COUNTERVALUE" (denoted by the symbol □). In this game COUNTERVALUE provides the means of (1) replacing the ICBM and ABM that are expended during the course of the battle and, (2) determing how many ICBM a player can launch during a turn. After each "salvo" (see page 5) both players have exhausted their respective arsenals; in this game, replenishment of these arsenals is determined by the COUNTERVALUE element. At the end of each salvo the players receive one ABM per intact COUNTERVALUE. For example, if a player loses three COUNTERVALUE during a salvo he may acquire 12 ABM since 12 COUNTERVALUE remain intact. The replacement of ICBM and determination of how many a player may launch during succeeding turns are determined by use of Table 2:

TABLE 2

| CV Remaining | ICBM Acquisition | ICBM Launch/Turn |
|---|---|---|
| 1–5 | 5 ICBM | 1 |
| 6–10 | 10 ICBM | 2 |
| 11–15 | 15 ICBM | 3 |

If a player loses six COUNTERVALUE (CV) he is, using Table 2, entitled to 10 ICBM for his next salvo. That player may launch only a maximum of two ICBM during each turn of that salvo.

VICTORY . . . AND DEFEAT

If at any time during a game a player loses all 15 ICBM COUNTERFORCE (▲) sites he can no longer attack his opponent's country; loss of all 15 COUNTERVALUE (□) sites results in the inability to replenish one's arsenal. In this game, either condition results in defeat. The first player to destroy 21 of his opponent's targets (COUNTERFORCE or COUNTERVALUE targets, ▲□● in any combination) is the winner.

GLOSSARY OF TERMS

COUNTERFORCE (CF):
The targeting of missiles for the destruction of military installations. In this game, the military target itself, rather than its targeting, is COUNTERFORCE.

COUNTERVALUE (CV):
The targeting of missiles for the destruction of civilian installations. In this game, the civilian target itself, rather than its targeting, is COUNTERVALUE.

RVSN (Raketnye Voiska Strategicheskogo Naznacheniya):
Russian designation for the Strategic Rocket Forces of the USSR.

AFB:
Air Force Base (US designation).

ICBM:
Intercontinental Ballistic Missile. Rocket capable of carrying a payload (measured as "megatonnage", "kilotonnage") +5,000 miles.

ABM:

Anti-Ballistic Missile. Rocket capable of destroying a ballistic missile.

FAIL-SAFE:

Policy of the US Strategic Air Command in which a bomber may not proceed toward a target beyond a certain point until a final affirming order has been issued. In this game, "FAIL-SAFE" represents a point where an OFFENSE ICBM is "detected" and defensive measures may be taken.

TABLE 3

| US | | SU | |
|---|---|---|---|
| Site | Coord. | Site | Coord. |
| COUNTERFORCE ( ) (red and white cards) | | COUNTERFORCE ( ) (red and white cards) | |
| Patrick AFB | US CFP3 | Petropavlovsk | SU CFR9 |
| Little Rock AFB | US CFN4 | Amur River RVSN | SU CFQ6 |
| Grand Forks AFB | US CFL8 | Baikinur | SU CFI5 |
| Ellsworth AFB | US CFL7 | Kansk | SU CFJ7 |
| Minot AFB | US CFK8 | Novosibirsk | SU CFJ6 |
| Warren AFB | US CFK6 | Semipalatinsk | SU CFJ5 |
| Luke AFB | US CFI3 | Tomsk RVSN | SU CFK6 |
| Mountain Home AFB | US CFI7 | Alma-Ata RVSN | SU CFH4 |
| McConnell AFB | US CFL5 | Tyuratam | SU CFG5 |
| Edwards AFB | US CFH5 | Ust-Kut RVSN | SU CFL7 |
| Mc Clellan AFB | US CFG6 | Chita | SU CFM6 |
| Whiteman AFB | US CFM5 | Lake Baikal | SU CFM7 |
| Dutch Harbour | US CFA11 | Novaya Zemlya RVSN | SU CFH10 |
| Pearl Harbor | US CFC4 | Gorki | SU CFF7 |
| Fairbanks AFB | US CFD12 | Kapustin Yar | SU CFF5 |
| COUNTERFORCE (•) (red cards) | | COUNTERFORCE (•) (white cards) | |
| Yukon, AL | US CFE12 | Smolensk | SU CFD8 |
| Bakersfield, CA | US CFH4 | Balkhash | SU CFH5 |
| Helena, MT | US CFJ7 | Kirov | SU CFF8 |
| Bartlesville, OK | US CFL4 | Russkaya | SU CFK8 |
| Toledo, OH | US CFO6 | Yakutsk | SU CFN10 |
| Elephant Mountain, ME | US CFQ8 | Komsomolsk | SU CFO7 |

TABLE 3

| US COUNTERVALUE (□): (red cards) | | SU COUNTERVALUE (□): (white cards) | |
|---|---|---|---|
| Site | Coord. | Site | Coord. |
| Washington, D.C. | US CVQ6 | Moscow | SU CVE8 |
| Boston | US CVR7 | Kiev | SU CVD7 |
| New York | US CVQ7 | Kuibyshev | SU CVF6 |
| Atlanta | US CVP4 | Archangelsk | SU CVF9 |
| Pittsburgh | US CVP6 | Lvov | SU CVC8 |
| Detroit | US CVN7 | Leningrad | SU CVE9 |
| Chicago | US CVN6 | Sebastopol | SU CVC6 |
| New Orleans | US CVN3 | Baku | SU CVD4 |
| Miami | US CVQ2 | Sverdlovsk | SU CVG7 |
| Dallas | US CVM3 | Irkutsk | SU CVL6 |
| Houston | US CVM2 | Riga | SU CVD9 |
| Denver | US CVK5 | Volgograd | SU CVD6 |
| San Francisco | US CVG5 | Omsk | SU CVI6 |
| Seattle | US CVG7 | Tashkent | SU CVG4 |
| Los Angeles | US CVG4 | Vladivostok | SU CVQ5 |

The red and white cards denoting US COUNTERFORCE are Target Coordinate and Launch Coordinate Cards, respectively. The white and red cards denoting SU COUNTERFORCE are Target Coordinate and Launch Coordinate Cards, respectively.

CONCLUSION

To recapitulate, the invention "FIRST-STRIKE: The Nuclear War Game" is classified as an amusement device in which the two players alternate between attack and defense. The game's object is to destroy "targets" in an opponent's country. From the invention's description the reader can see that this war game's modes of attack and defense, with "missiles" (represented by playing pieces), Launch and Target Coordinate Cards and "Megadeath" markers, make it both novel and unobvious. I believe that FIRST-STRIKE: The Nuclear War Game provides an enjoyable, yet economical board game which should be of recreational interest to a large segment of the population.

What is claimed is:

1. A board game in which players alternate on attack and defense simulating thermonuclear war between two countries, comprising:

(a) a game board subdivided into squares utilizing an alphanumeric grid pattern on which said countries are located at opposing ends with various symbols denoting target sites, some of said target sites being further denoted by one of said various symbols as launch sites (b) a plurality of game playing pieces denoting the nuclear weapons used in the game for said attack and defense, (c) a plurality of game cards denoting name and board location of said targets, said game cards divided into at least two sets, a first set of game cards each having indicia designating it as a launch card and comprising one of said various symbols denoting a launch site and a second set of game cards each having indicia designating it as a target card and comprising one of said various symbols denoting a target site, thus said game cards providing means for randomly selecting launch sites and target sites of said game playing pieces, (d) a plurality of markers which provide means to label targets that have been destroyed in the game and, (e) four dice which provide means of movement of said game playing pieces.

* * * * *

UNITED STATES PATENT AND TRADEMARK OFFICE

CERTIFICATE OF CORRECTION

PATENT NO. : 4,765,627

DATED : August 23, 1988

INVENTOR(S) : Sherman Edward Ross

It is certified that error appears in the above-identified patent and that said Letters Patent is hereby corrected as shown below:

Column 2, line 34, "110" should read -- 11 1/4 --.

Signed and Sealed this

Thirty-first Day of January, 1989

*Attest:*

DONALD J. QUIGG

*Attesting Officer*

*Commissioner of Patents and Trademarks*